US008801090B2

(12) United States Patent
Akkad

(10) Patent No.: US 8,801,090 B2
(45) Date of Patent: Aug. 12, 2014

(54) FOLDABLE CHAIR

(75) Inventor: Benjamin Akkad, New York, NY (US)

(73) Assignee: Idea Nuova, Inc., New York, NY (US)

( * ) Notice: Subject to any disclaimer, the term of this patent is extended or adjusted under 35 U.S.C. 154(b) by 0 days.

(21) Appl. No.: 13/570,472

(22) Filed: Aug. 9, 2012

(65) Prior Publication Data

US 2014/0042779 A1 Feb. 13, 2014

(51) Int. Cl.
*A47C 4/00* (2006.01)

(52) U.S. Cl.
USPC ..... 297/46

(58) Field of Classification Search
USPC ..... 297/16.1, 16.2, 46, 48, 51, 55, 56
See application file for complete search history.

(56) References Cited

U.S. PATENT DOCUMENTS

| | | | | |
|---|---|---|---|---|
| 244,216 | A | 7/1881 | Fenby | |
| 398,943 | A | 3/1889 | Crandall | |
| 615,476 | A | 12/1898 | Chapman | |
| 1,027,692 | A | 5/1912 | Cole | |
| 1,185,568 | A | 5/1916 | Zeunert | |
| 1,263,717 | A | 4/1918 | Stone | |
| 1,443,734 | A | 1/1923 | Clyde | |
| 1,939,743 | A | 12/1933 | Warner | |
| 1,942,112 | A | 1/1934 | McQuilkin | |
| 2,074,998 | A * | 3/1937 | Kaufman | 297/48 |
| 2,381,574 | A | 8/1945 | Clarin | |
| 2,473,090 | A | 6/1949 | Becker | |
| 2,587,543 | A | 2/1952 | Smith | |
| D171,176 | S | 12/1953 | Yellen | |
| 2,691,410 | A | 10/1954 | Boucher | |
| 2,712,349 | A | 7/1955 | LeVoir | |
| 2,713,890 | A | 7/1955 | Mack | |
| 2,733,755 | A | 2/1956 | Boucher | |
| D180,210 | S | 4/1957 | Uretsky | |
| 2,902,084 | A | 9/1959 | Stevens | |
| 3,123,396 | A | 3/1964 | Searle | |
| 3,124,387 | A | 3/1964 | MacLaren | |
| 3,136,272 | A | 6/1964 | Sprigman | |

(Continued)

FOREIGN PATENT DOCUMENTS

| | | |
|---|---|---|
| CN | 87201431 U | 2/1988 |
| CN | 2103938 | 5/1992 |

(Continued)

OTHER PUBLICATIONS

Office Action Issued Oct. 18, 2010 in U.S. Appl. No. 12/544,256.

*Primary Examiner* — Milton Nelson, Jr.
(74) *Attorney, Agent, or Firm* — Panitch Schwarze Belisario & Nadel LLP

(57) ABSTRACT

A chair that is reconfigurable between a folded and an unfolded configuration includes a first leg having an intermediate portion located between a first end and an opposite second end of the first leg and a second leg having an intermediate portion located between a first end and an opposite second end of the second leg. The intermediate portion of the second leg is pivotally connected to the intermediate portion of the first leg. A support member has a first end pivotally connected to the first leg and an opposite second end. A seat frame has a first portion pivotally connected to the second end of the support member and a second portion pivotally connected to the second end of the second leg. The second end of the support member is adjacent the first end of both the first and second legs in the folded configuration.

13 Claims, 6 Drawing Sheets

(56) References Cited

U.S. PATENT DOCUMENTS 3,635,520 A 1/1972 Roher et al.
3,838,883 A 10/1974 Machen
3,941,416 A 3/1976 Uchida
4,045,045 A 8/1977 Boucher et al.
4,047,752 A 9/1977 Rohr
4,105,244 A 8/1978 Colby
4,118,065 A 10/1978 Watkins
4,193,630 A 3/1980 Steele
4,231,582 A 11/1980 Moss
4,258,951 A 3/1981 Groom
4,290,643 A 9/1981 Logan, III
D262,674 S 1/1982 Logan, 3rd
D267,057 S 11/1982 Koehm
4,514,009 A 4/1985 Vanderminden et al.
4,605,261 A 8/1986 Lee
4,652,047 A 3/1987 Chan
D290,557 S 6/1987 Salvati et al.
4,671,566 A 6/1987 Knapp et al.
4,685,725 A 8/1987 Helfrich
4,715,650 A 12/1987 Berman et al.
4,717,201 A 1/1988 Barras
4,789,123 A 12/1988 Mattsson
4,826,241 A 5/1989 Barras
4,867,505 A 9/1989 Parker
4,889,383 A 12/1989 Jones
4,934,638 A 6/1990 Davis
D310,605 S 9/1990 Kwon
5,058,950 A 10/1991 Mann
5,176,393 A 1/1993 Robertson et al.
5,246,265 A 9/1993 Nagan et al.
5,320,404 A 6/1994 Le Gal
5,335,967 A 8/1994 Vanderminden, Sr.
5,494,333 A 2/1996 Wilson
5,499,857 A 3/1996 Lynch, Jr.
5,522,642 A 6/1996 Herzog
5,580,129 A 12/1996 Findlay
D380,306 S 7/1997 Lin
D382,126 S 8/1997 Lee
D382,414 S 8/1997 Lee
5,718,473 A 2/1998 Lynch, Jr.
5,848,822 A 12/1998 Wu
5,893,605 A 4/1999 Chang
D411,387 S 6/1999 Zheng
5,979,976 A 11/1999 Ferencik
5,984,406 A 11/1999 Lee
6,045,177 A 4/2000 Grace
6,056,354 A 5/2000 Tseng
6,082,813 A 7/2000 Chen
6,095,607 A 8/2000 Wenzel
6,112,757 A 9/2000 Tseng
D431,382 S 10/2000 Eloge et al.
D432,325 S 10/2000 Zheng et al.
D432,823 S 10/2000 Zheng
D433,244 S 11/2000 Zheng
D433,574 S 11/2000 Zheng
6,149,238 A 11/2000 Tsai
6,179,374 B1 1/2001 Tang
6,209,951 B1 4/2001 Han
6,231,119 B1 5/2001 Zheng
6,237,993 B1 5/2001 Zheng
6,238,001 B1 5/2001 Yoran
6,241,311 B1 6/2001 Zheng
6,247,748 B1 6/2001 Zheng
6,264,271 B1 7/2001 Munn et al.
6,283,046 B1 9/2001 Tseng
6,296,304 B1 10/2001 Zheng
6,302,479 B1 10/2001 Zheng
6,322,138 B1 11/2001 Tang
6,332,646 B1 * 12/2001 Tseng ..... 297/16.1
6,354,657 B1 3/2002 Nelson et al.
6,364,411 B1 4/2002 Zheng
6,371,553 B1 4/2002 Tang
D456,628 S 5/2002 Satoshi
6,382,715 B1 5/2002 Tang
6,382,729 B1 5/2002 Wu
6,402,230 B1 6/2002 Tang
D460,280 S 7/2002 Fox
6,419,311 B1 7/2002 Tang
6,447,057 B1 9/2002 Chen
6,454,348 B1 9/2002 Wu
6,471,288 B2 * 10/2002 Alexander, Jr. ..... 297/56
6,488,331 B2 12/2002 Chen
6,494,530 B1 12/2002 Zheng
D468,939 S 1/2003 Zheng
6,505,885 B1 1/2003 Tang
6,547,322 B2 4/2003 Marx
6,601,912 B1 8/2003 Chen
6,607,240 B2 8/2003 Zheng
6,629,722 B1 10/2003 Tang
6,634,705 B1 10/2003 Zheng
6,637,811 B2 10/2003 Zheng
6,644,731 B2 11/2003 Tang
6,669,280 B1 * 12/2003 Wegner ..... 297/16.2
6,669,281 B1 12/2003 Huang
6,682,135 B2 1/2004 Zheng
D486,310 S 2/2004 Goldy
6,698,827 B2 3/2004 Le Gette et al.
6,702,371 B2 3/2004 Zheng
6,715,824 B2 4/2004 Zheng
6,736,450 B2 5/2004 Miyagi
6,755,462 B2 6/2004 Zheng
6,779,838 B2 8/2004 Chang
6,814,403 B2 11/2004 Zheng
6,817,661 B2 11/2004 Zheng
6,817,671 B1 11/2004 Zheng
6,820,927 B2 11/2004 Isom et al.
6,824,207 B1 11/2004 Lin
6,824,208 B2 11/2004 Zheng
6,824,210 B2 11/2004 Zheng
D500,605 S 1/2005 Schmidt et al.
6,840,574 B1 1/2005 Wu
6,848,740 B1 2/2005 Reese
D503,554 S 4/2005 Kay
6,899,383 B2 5/2005 Hwang
D507,892 S 8/2005 Zheng
6,926,355 B2 8/2005 Le Gette et al.
6,926,356 B2 8/2005 Chen
6,938,951 B1 * 9/2005 Tseng ..... 297/16.1
6,957,852 B1 10/2005 Hsieh
6,971,712 B1 * 12/2005 Tseng ..... 297/32
D515,830 S 2/2006 Zheng
6,997,634 B2 2/2006 Zheng
7,000,983 B1 2/2006 Tsai
D516,825 S 3/2006 Zheng
D516,826 S 3/2006 Zheng
D517,819 S 3/2006 Zheng
7,011,372 B1 3/2006 Hsieh
7,017,985 B2 3/2006 Chen
D522,263 S 6/2006 Hart
7,073,852 B1 7/2006 Zheng
7,100,877 B2 9/2006 Bourke et al.
7,100,975 B1 9/2006 Zheng
D529,304 S 10/2006 Le Gal
D529,728 S 10/2006 Le Gal
7,140,689 B2 11/2006 Zheng
7,144,078 B2 12/2006 Hsieh
7,178,864 B2 2/2007 Hsieh
7,219,955 B2 5/2007 Lu et al.
7,229,128 B2 6/2007 Lee
7,229,131 B2 6/2007 Chen
7,328,940 B2 2/2008 Zheng
7,396,073 B2 7/2008 Zheng
7,404,601 B2 7/2008 Chen
7,441,287 B2 10/2008 Zheng
7,600,810 B2 10/2009 Chen et al.
7,967,374 B2 * 6/2011 Akkad ..... 297/42
2002/0024240 A1 2/2002 Chen
2002/0043822 A1 4/2002 Choi et al.
2002/0074834 A1 6/2002 Summar et al.
2003/0006632 A1 1/2003 Ku
2003/0015892 A1 1/2003 Wu
2003/0020304 A1 1/2003 Zheng
2003/0052518 A1 3/2003 Zheng
2003/0057741 A1 3/2003 Zheng

(56) References Cited

U.S. PATENT DOCUMENTS

| | | | | |
|---|---|---|---|---|
| 2003/0057747 | A1 | 3/2003 | Johnston | |
| 2003/0094836 | A1 | 5/2003 | Chen | |
| 2003/0111872 | A1 | 6/2003 | Zheng | |
| 2003/0111874 | A1 | 6/2003 | Zheng | |
| 2003/0127885 | A1 | 7/2003 | Tang | |
| 2003/0234561 | A1 | 12/2003 | Zheng | |
| 2004/0007903 | A1 | 1/2004 | Chang | |
| 2004/0036323 | A1 | 2/2004 | Hwang | |
| 2004/0066075 | A1 | 4/2004 | Yeh | |
| 2004/0094996 | A1 | 5/2004 | Zheng | |
| 2004/0094997 | A1 | 5/2004 | Zheng | |
| 2004/0113476 | A1 | 6/2004 | Chang | |
| 2004/0130190 | A1 | 7/2004 | Zheng | |
| 2004/0135405 | A1 | 7/2004 | Zheng | |
| 2004/0232740 | A1* | 11/2004 | Enge | 297/16.2 |
| 2004/0245810 | A1 | 12/2004 | Tseng | |
| 2005/0077758 | A1 | 4/2005 | Reese | |
| 2005/0088018 | A1 | 4/2005 | Yao | |
| 2005/0236873 | A1 | 10/2005 | Edward | |
| 2005/0248202 | A1 | 11/2005 | Zheng | |
| 2006/0186711 | A1 | 8/2006 | Phipps | |
| 2007/0029846 | A1* | 2/2007 | Cohen | 297/16.1 |
| 2007/0102974 | A1 | 5/2007 | Chen | |
| 2007/0187998 | A1 | 8/2007 | Chen | |
| 2007/0200395 | A1 | 8/2007 | Zheng | |
| 2007/0267901 | A1 | 11/2007 | Zheng | |
| 2008/0224504 | A1 | 9/2008 | Fargason | |
| 2008/0231088 | A1 | 9/2008 | Zheng | |
| 2010/0164256 | A1 | 7/2010 | Salisbury | |

FOREIGN PATENT DOCUMENTS

| | | | |
|---|---|---|---|
| CN | 2117779 | U | 10/1992 |
| CN | 2137107 | Y | 6/1993 |
| CN | 2179041 | Y | 10/1994 |
| CN | 2188885 | Y | 2/1995 |
| CN | 2196945 | Y | 5/1995 |
| CN | 1139537 | A | 1/1997 |
| CN | 2326083 | Y | 6/1999 |
| CN | 2328266 | Y | 7/1999 |
| CN | 2339063 | Y | 9/1999 |
| CN | 2349884 | Y | 11/1999 |
| CN | 2367154 | Y | 3/2000 |
| EP | 139306 | A1 | 5/1985 |
| EP | 997090 | A1 | 5/2000 |
| FR | 2833824 | A1 | 6/2003 |
| FR | 2837081 | A1 | 9/2003 |
| GB | 599760 | A | 3/1948 |
| GB | 2022405 | A | 12/1979 |
| GB | 2025213 | A | 1/1980 |
| GB | 2331233 | A | 5/1999 |
| JP | 38-12532 | | 6/1938 |
| JP | 50123508 | A | 9/1975 |
| JP | 51127856 | A | 11/1976 |
| JP | 55120347 | A | 9/1980 |
| JP | 2001070077 | A | 3/2001 |
| JP | 2002165667 | A | 6/2002 |
| JP | 2002233429 | A | 8/2002 |
| JP | 2002360371 | A | 12/2002 |
| JP | 2004105557 | A | 4/2004 |
| WO | 2004021835 | A1 | 3/2004 |

* cited by examiner

FOLDABLE CHAIR

BACKGROUND OF THE INVENTION

The present invention generally relates to a foldable chair and, more particularly, to a chair reconfigurable between a folded configuration for storage and an unfolded configuration for supporting an individual above a support surface.

Foldable chairs are well known in the art to provide for easy displacement and compact storage during non-use. Some conventional foldable chairs include one or more separable components to allow the chair to have a relatively compact configuration for storage. Unfortunately, the separable components can be inadvertently misplaced and the relatively intricate components that are removably attachable can be easily damaged. Other conventional foldable chairs have telescoping members that allow for a relatively compact storage configuration. Unfortunately, such a configuration can be relatively expensive to produce and pieces of clothing and/or skin can be inadvertently caught in between the sliding telescoping members. Further, it can be difficult to determine when the telescoping members are properly "locked" in a position capable of supporting an individual in an unfolded configuration and, therefore, such foldable chairs can be problematic for a user.

Therefore, it would be desirable to provide a foldable chair that overcomes the above-identified disadvantages. Specifically, it would be desirable to provide a chair having several pivotably, yet permanently attached, components such that the chair is easily reconfigurable between a folded, compact storage configuration and an unfolded use configuration. It would be desirable to produce such a structurally-strong chair in a relatively inexpensive manner.

BRIEF SUMMARY OF THE INVENTION

In a first aspect, the present invention provides a chair reconfigurable between a folded and unfolded configuration. The chair includes a first leg, a second leg, a locking mechanism and a seat frame. The first leg has a first member that includes a first end for supporting the chair on a support surface in the unfolded configuration and a second end, opposite the first end. The first leg also has a second member that includes a first end pivotably connected to the second end of the first member, and a second end opposite the first end extending upwardly and rearwardly from the first end in the unfolded configuration. The second leg has a first end for supporting the chair on the support surface in the unfolded configuration, and a second end, opposite the first end of the second leg, that extends upwardly and forwardly from the first end in the unfolded configuration. The second leg also has an intermediate portion between the first and second ends of the second leg that is pivotably connected to the first member of the first leg, adjacent the second end of the first member. The locking mechanism is connected to the first leg to releasably lock the chair in the unfoldable configuration. The seat frame has a first portion pivotably connected adjacent to the second end of the second leg, and a second portion pivotably connected adjacent to the second end of the second member. The second end of the second member pivots toward the first end of the first member when the chair is moved to the folded configuration.

In a second aspect, the present invention provides a chair reconfigurable between a folded and unfolded configuration. The chair includes a first leg, a second leg and a locking mechanism. The first leg has a first member that includes an opening, and a second member pivotably connected to the first member and which includes a through hole. The second leg is pivotably connected to the first leg. The locking mechanism is connected to the second member of the first leg to lock the chair in the unfolded configuration. The locking mechanism includes a lever and a pin. The lever is pivotably connected to the second member. The pin is connected to the lever and extends through and out of the through hole of the second member. The pin is movable between a lock position, wherein the pin extends through and out of the opening of the first member and an unlocked position, wherein the pin is retracted from the opening of the first member.

BRIEF DESCRIPTION OF THE SEVERAL VIEWS OF THE DRAWINGS

The foregoing summary, as well as the following detailed description of the preferred embodiment of the present invention, will be better understood when read in conjunction with the appended drawings. For the purpose of illustrating the invention, there is shown in the drawings an embodiment that is presently preferred. It should be understood, however, that the invention is not limited to the precise arrangements and instrumentalities shown.

In the drawings.

DETAILED DESCRIPTION OF THE INVENTION

Figure 1:
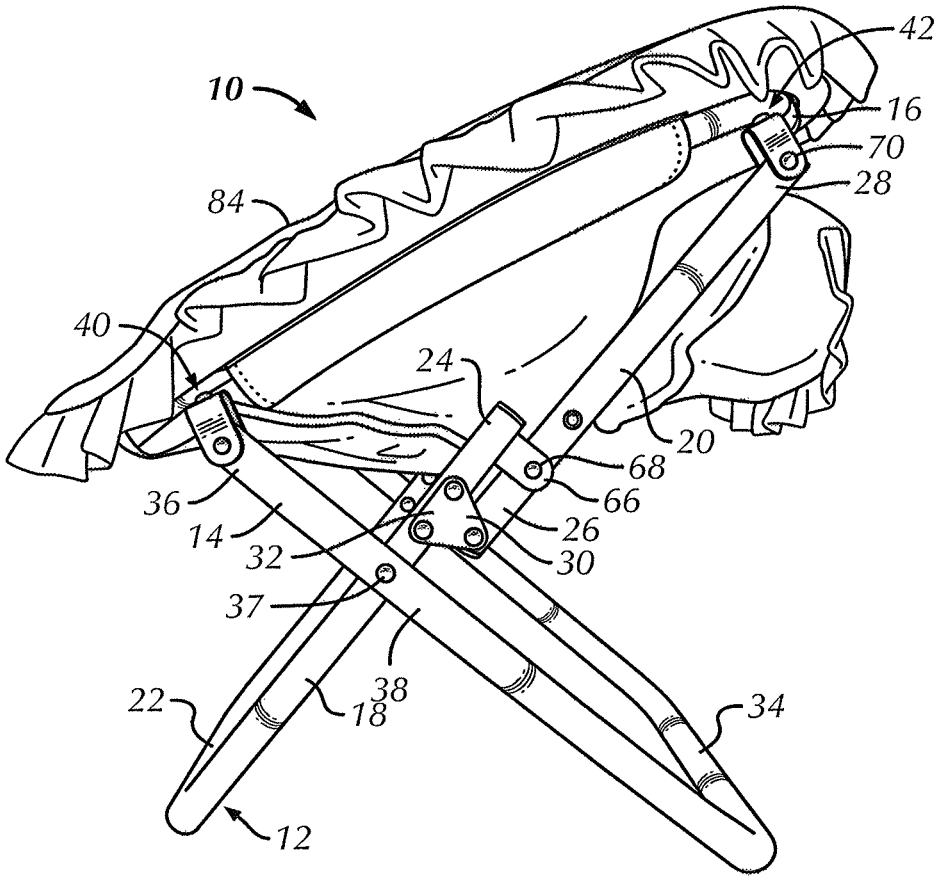
FIG. 1 is a right side perspective view of a foldable chair in the unfolded configuration in accordance with a preferred embodiment of the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the chair in accordance with the present invention, and designated parts thereof. Unless specifically set forth herein, the terms "a", "an" and "the" are not limited to one element but instead should be read as meaning "at least one." The terminology includes the words noted above, derivatives thereof and words of similar import.

In a first preferred embodiment, the present invention provides a foldable chair 10, as shown in FIGS. 1-9. The foldable chair 10 includes a first leg 12, a second leg 14, a locking mechanism 44 (FIG. 7) and a seat frame 16. The first leg 12 has a first member 18 and a second member 20. The first member 18 is configured as shown in FIG. 1 and includes a first end 22 for supporting the chair on a support surface in the unfolded configuration. The first member 18 also includes a second end 24, that is opposite the first end 22. In general, the first member 18 of the first leg 12 is U-shaped and formed from a tubular member bent into the U-shaped configuration. While the first leg 12 is preferably formed from a tubular member, it can alternatively be formed from any other elongated member having a cross-sectional profile of a square, rectangle, oval, diamond, trapezoid and the like. Additionally, while the first leg 12 is preferably U-shaped, the shape of the first leg 12 can alternatively be configured into any other shape that adequately provides for a stable base configuration suitable for sitting on.

The second member 20 includes a first end 26 that is pivotably connected adjacent to the second end 24 of the first member 18. Preferably, the first end 26 is pivotably connected to the first member 18 at a position slightly spaced apart (toward the first end 22) from the second end 24. The second member 20 can be pivotably connected the first member 18 by a hinge 30. The hinge 30 can be any hinge generally known in the art to allow one member to pivot relative to another member. However, the hinge 30 is preferably configured, as shown in FIG. 1, having a pair of triangular shaped base members 32 connected to the lateral and medial sides of the first and second members 18, 20. The triangular shaped members 32 each includes two ends rigidly connected to the first member 18 at a position spaced apart from the second end 24 and a third end pivotably connected to the second member 20 proximate to the first end 26. The second member 20 also has a second end 28 that is opposite the first end 26 and extends generally upwardly and rearwardly from the first end 26 in the unfolded configuration (FIG. 1).

The second leg 14 includes a first end 34 for supporting the chair 10 on a support surface in the unfolded configuration. The second leg 14 also includes a second end 36 that is opposite the first end 34 and extends generally upwardly and forwardly from the first end 34 in the unfolded configuration. An intermediate portion 38 of the second leg 14 extends between the first end 34 and the second end 36 and is pivotably connected to the first member 18 of the first leg 12, adjacent the second end 24 of the first member 18, but further away from the second end 24 than the hinge 30. Preferably, the first member 18 of the first leg 12 is pivotably connected to an upper portion of the second leg 14 about ⅔ of the length of the second leg 14 from the first end 34 by a pivot axle 37, such as a rivet, a pin or a dowel.

In general, the second leg 14 is U-shaped and formed from a tubular member bent into the U-shaped configuration. While the second leg 14 is preferably formed from a tubular member, it can alternatively be formed from any other elongated member having a cross-sectional profile of a square, rectangle, oval, diamond, trapezoid and the like. Additionally, while the second leg 14 is preferably U-shaped, the shape of the second leg 14 can alternatively be configured into any other shape that adequately provides for a stable base configuration suitable for sitting on.

The seat frame 16 is generally configured as a circular seat frame 16, but can alternatively be configured as any other shape, that allows the seat frame 16 to have a first portion and a second portion pivotably connected to the first and second legs 12, 14. Exemplary configurations of the seat frame 16 can include an oval, a square, a rectangle, a triangle, a trapezoid, and the like. Preferably, the seat frame 16 is a circular seat frame having a first portion 40 pivotably connected adjacent to the second end 36 of the second leg 14, and a second portion 42 pivotably connected adjacent to the second end 28 of the second member 20 of the first leg 12. In operation, as further discussed below, when the chair 10 is moved from the unfolded configuration (FIG. 1) to the folded configuration (FIG. 5), the second end 28 of the second member 20 of the first leg 12 pivots toward the first end 22 of the first member 18 of the first leg 12.

The first leg 12, the second leg 14 and the seat frame 16 are preferably formed from metal, such as steel, aluminum, titanium, and the like. However, any other suitably strong material can be used instead of metal, such as, plastics, wood, and composite materials (e.g., ceramics). Such materials for forming a foldable chair to sufficiently support the weight of a user are known in the art.

Referring to FIGS. 6-10B, the foldable chair 10 further includes a locking mechanism 44 having a lever 46, a pin 48 and a biasing member 56. The locking mechanism 44 is connected to the inner side of the first leg 12 to releasably lock the foldable chair 10 in the unfolded configuration.

Figure 8:
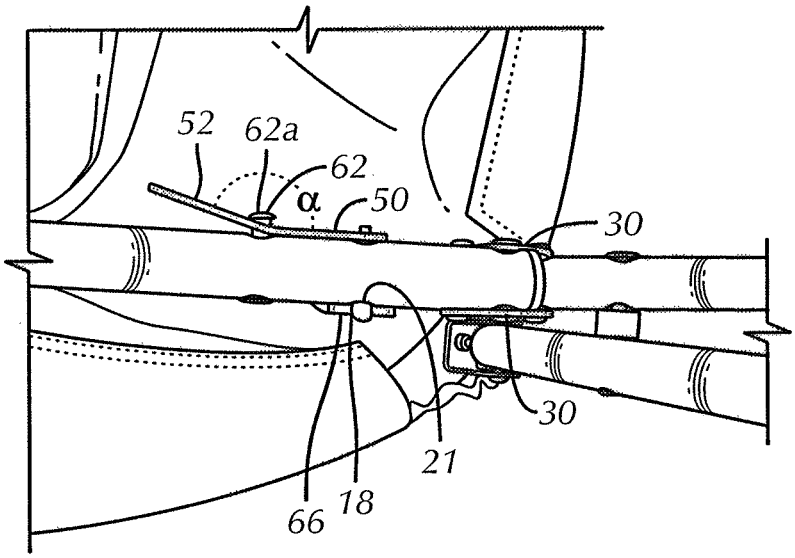
FIG. 8 is an enlarged, top plan view of the locking mechanism of FIG. 7 in a locking position.
Figure 9:
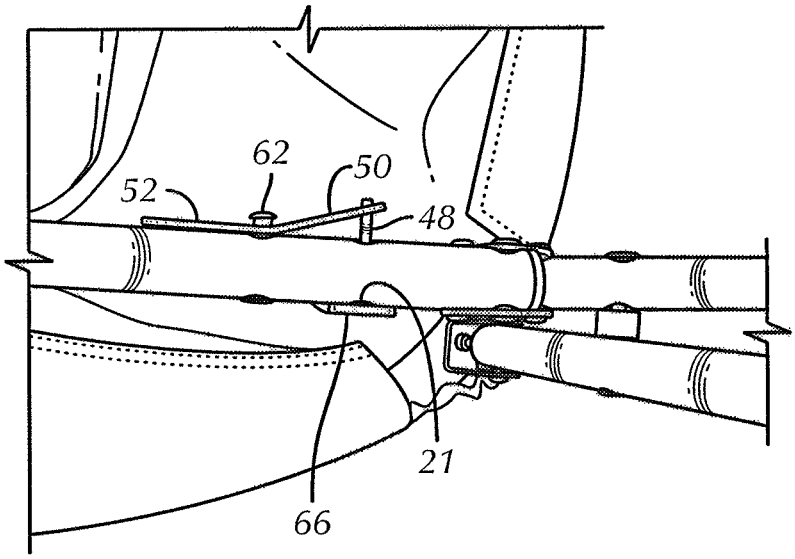
FIG. 9 is an enlarged, top plan view of the locking mechanism of FIG. 7 in an unlocking position.

The lever 46 includes a first extension 50 having a first end 50*a* and a second end 50*b*. The first extension 50 is generally configured as an elongated planar member having a slotted aperture 58 about the first end 50*a*. The slotted aperture 58 extends through the first extension 50 and includes a circular portion 58*a* in communication with a rectangular portion 58*b* for receiving and retaining the pin 48, as further described below. The second extension 52 is connected to the second end 50*b* of the first extension 50 and extends therefrom at an obtuse angle $\alpha$ (FIG. 8) with respect to a plane that is parallel to the first extension 50. The obtuse angle $\alpha$ can be any angle greater than 90 degrees that allows for sufficient cantilevering of the lever 46 to cantilever out the pin 48 from the flange 66. For example, the obtuse angle $\alpha$ can be 100, 120, 130, 140, 150, 160 or 170 degrees. Preferably, the obtuse angle $\alpha$ is about 160 degrees. The second extension 52 is similar to the first extension 50 and configured as a generally planar elongated member. The second extension 52 also includes an opening 60 extending through a first end 52*a* near its connection to the first extension 50. The opening 60 is connected to a rivet, pin or axle 62 rigidly secured to the second member 20 near the first end 26. The rivet 62 has a head 62*a* positioned to extend a sufficient distance from the second member 20, such that when the lever 46 is connected thereto, the first extension 50 can lay substantially parallel to the second member 20, as shown in FIG. 8. The rivet 62 also acts a pivot about which the lever 46 can pivot between its locked position (FIG. 8) and unlocked position (FIG. 9).

Figure 10A:
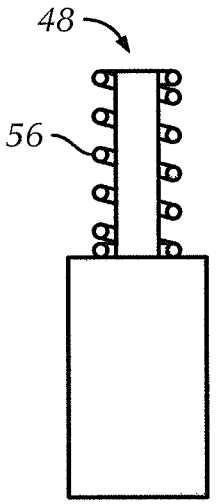
FIG. 10A is a front elevational view of a pin of the locking mechanism of FIG. 7.
Figure 10B:
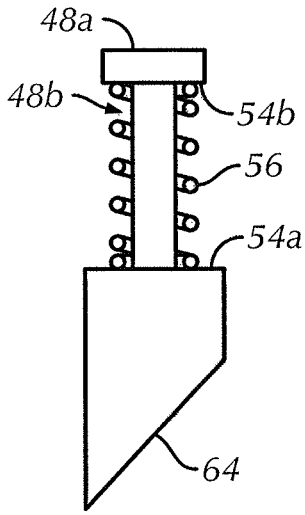
FIG. 10B is a side elevational view of the pin of FIG. 10A.
Figure 11A:
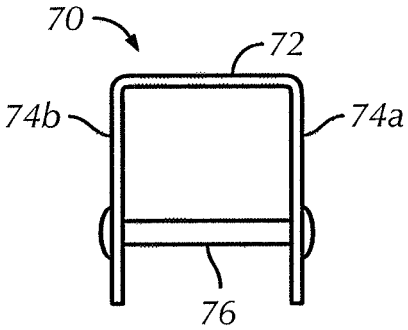
FIG. 11A is a front elevational view of a pivot seat of the foldable chair of FIG. 1.
Figure 11B:
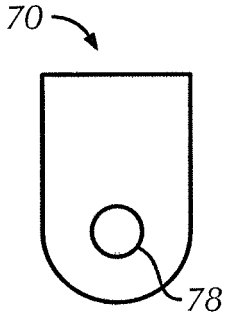
FIG. 11B is a side elevational view of the pivot seat of FIG. 11A.
Figure 11C:
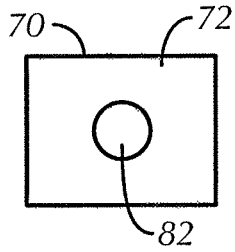
FIG. 11C is a top plan view of the pivot seat of FIG. 11A.

The pin 48 is pivotably connected adjacent to the first end 50*a* of the first extension 50 and extends therefrom. The pin 48 is best shown in FIGS. 10A and 10B. The pin 48 is generally configured as a cylindrical pin having a tapered, beveled or sloped distal end 64. The pin 48 is also configured such that the sloped distal end 64 faces in the direction of the flange 66 such that as the flange 66 engages the pin 48 it cams against the sloped distal end 64. The proximal portion 48*b* of the pin 48 is recessed about its lateral sides to form a substantially T-shaped cross-section, as shown in FIG. 10B. Thus, the pin 48 includes a first abutment surface 54*a* and a second abutment surface 54*b*. In assembling the pin 48 to the lever 46, the top end 48*a* of the pin 48 passes through the circular aperture 58*a* and is then slid to the rectangular slot 58*b*, owing to the recessed T-shaped configuration of the pin 48. When assembled to the lever 46, the first extension 50 forming the rectangular slot 58*b* engages the second abutment surface 54*b* in order to retain the pin 48 to the lever 46.

The lever 46 and pin 48 are preferably formed from metal, such as steel, aluminum, titanium and the like. However, the lever 46 and pin 48 can alternatively be formed from any other suitably strong material instead of metal, such as, plastics, wood and composite materials (e.g., ceramics).

A biasing member 56 is positioned on the pin 48, as shown in FIG. 10B. The biasing member 56 however, engages the first abutment surface 54*a* on one end and when assembled to the second member 20, is positioned to engage an inner surface (not shown) of the second member 20. When fully assembled to the second member 20, the biasing member 56 biases the pin 48 to the locked position, as shown in FIG. 8. That is, the pin 48 extends through and out of an opening 21 that traverses the second member 20. The opening 21 is preferably oriented to extend horizontally relative to the orientation of the second member 20 in the unfolded configuration.

The locking mechanism 44 operates to lock the second member 20 of the first leg 12 to the first member 18. The first member 18 includes a flange 66 (FIGS. 6 and 7) that extends from the first member 18 and includes an aperture 68 for receiving the pin 48. The flange 66 is connected to the first member 18 adjacent to the second end 24 so as to extend rearwardly and downwardly when the foldable chair 10 is in the unfolded configuration. Additionally, the flange 66 is connected to the first member 18 such that a medial side of the flange 66 is slightly spaced apart from a lateral side of the first member 18 so as to be slightly spaced apart from the second member 20 when the second member 20 is pivoted to the unfolded configuration.

In general, the locking mechanism 44 and flange 66 operate as cooperating catches to releasably hold the foldable chair 10 in the unfolded configuration. In other words, the first and second members 18, 20 include at least one catch to releasably hold the foldable chair 10 in the unfolded configuration. In particular, the first member 18 is configured with a catch 66 and the second member 20 is configured a pin 48 that releasably engages the catch 66 when the pin 48 extends out of the opening 21 of the second member 20. As discussed above, the catch 66 is configured as a flange extending rearwardly about a lateral side of the first member 18.

The pin 48 is movable between a first position (FIG. 8) substantially within the second member 20 with the distal end extending out of the second member 20 and into the aperture 18 of the flange 66, and a second position (FIG. 9) extending from the second member 20. The pin 48 is moved between the first and second positions by the biasing member 56 housed within the second member 20 that biases the pin to the first position such that the pin 48 extends through the opening 21 of the second member 20. The pin 48 is moved to the second position against the bias of the biasing member 56 by operation of the lever 46 by a user. The biasing member 56 can be any biasing member known in the art and capable of its intended use. Preferably, the biasing member 56 is a compression spring 56 that circumscribes the proximal end 48*b* of the pin 48. However, the biasing member 56 can be any biasing member sufficient to bias the pin 48 to the first position, such as a leaf spring, a constant force spring, and the like.

Figure 2:
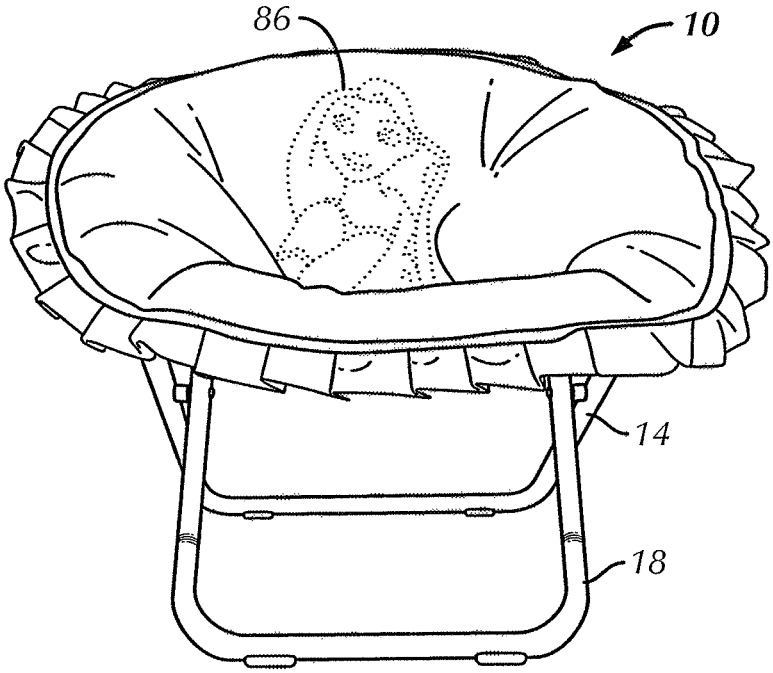
FIG. 2 is a front perspective view of the foldable chair of FIG. 1.
Figure 3:
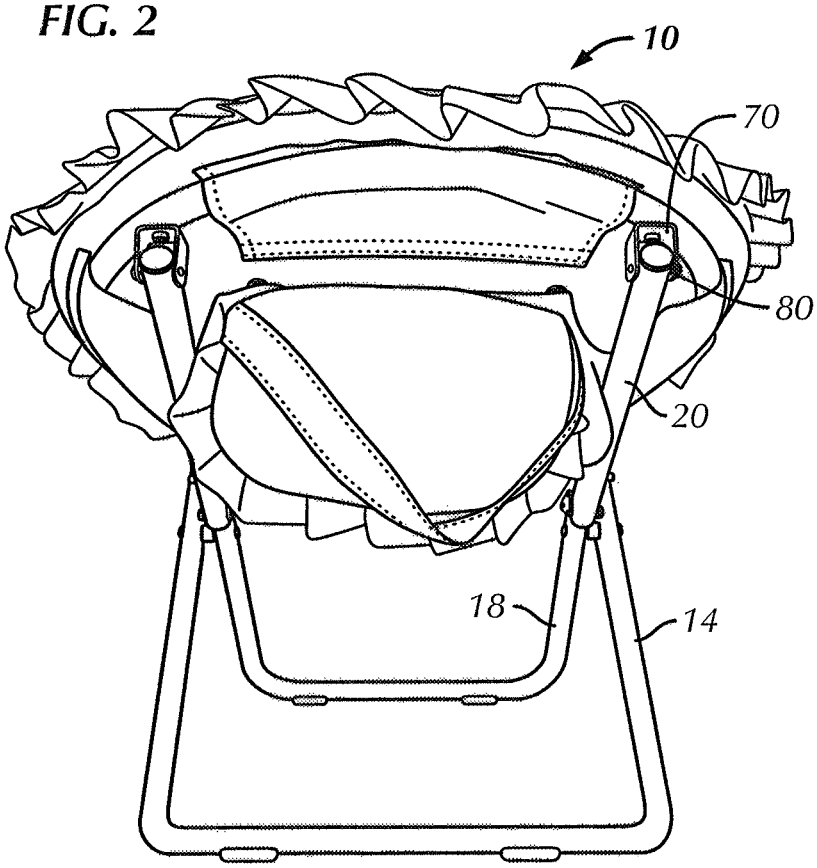
FIG. 3 is a rear perspective view of the foldable chair of FIG. 1.
Figure 4:
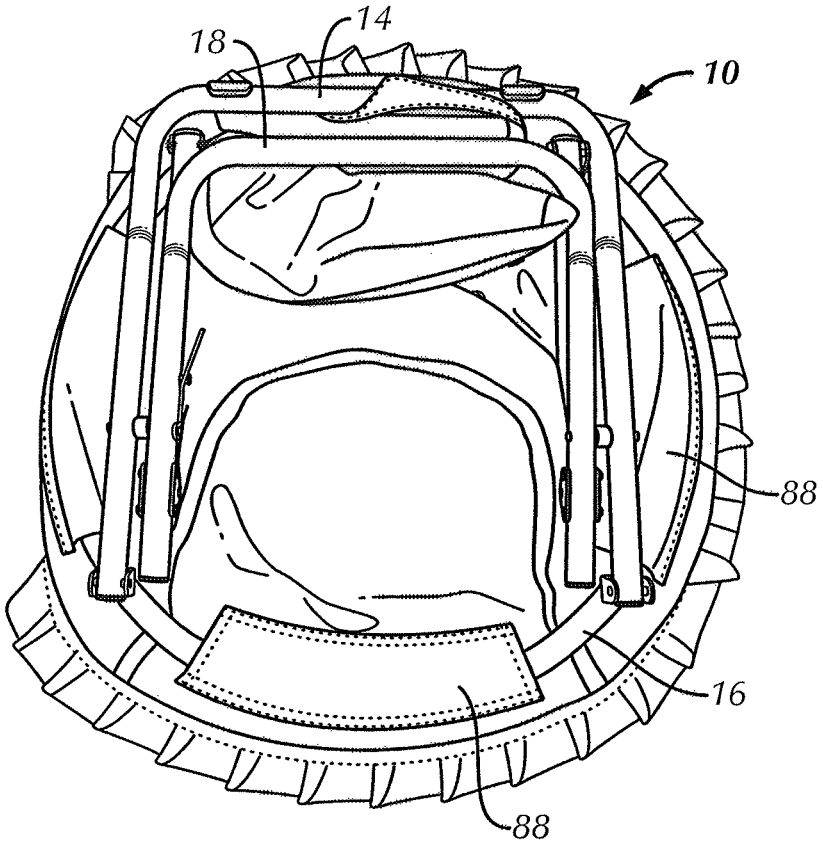
FIG. 4 is a bottom plan view of the foldable chair of FIG. 1 in a folded configuration.
Figure 5:
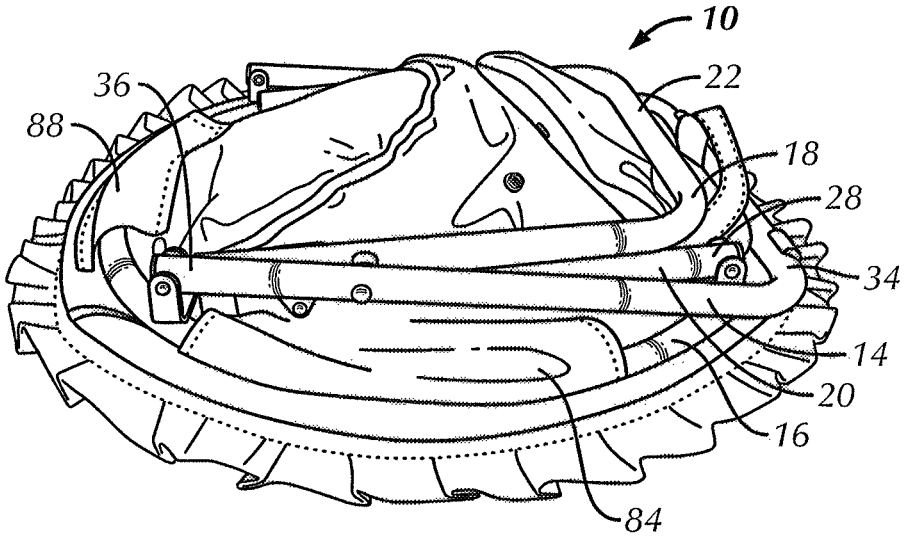
FIG. 5 is a side perspective view of the foldable chair of FIG. 4.
Figure 6:
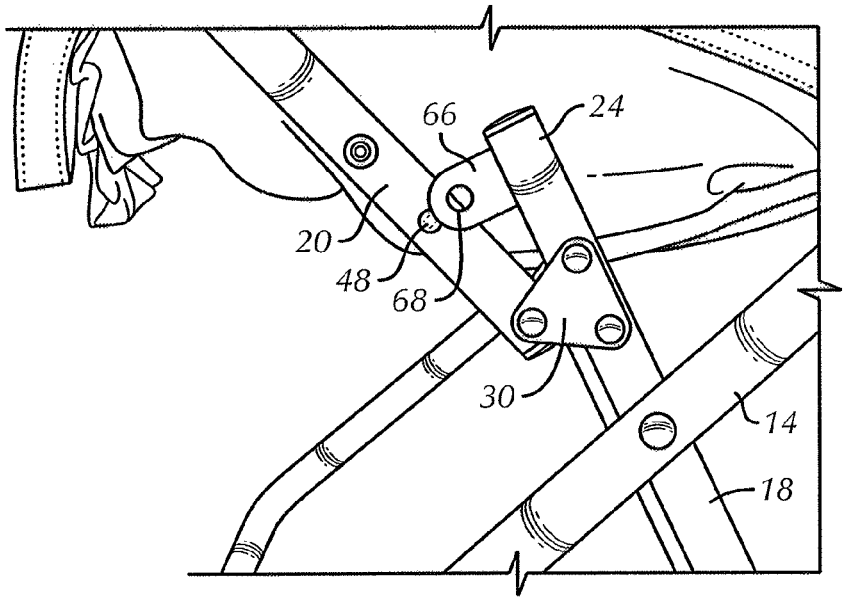
FIG. 6 is an enlarged, partial, left side, perspective view of a locking mechanism of the foldable chair of FIG. 1, immediately prior to the fully unfolded configuration.
Figure 7:
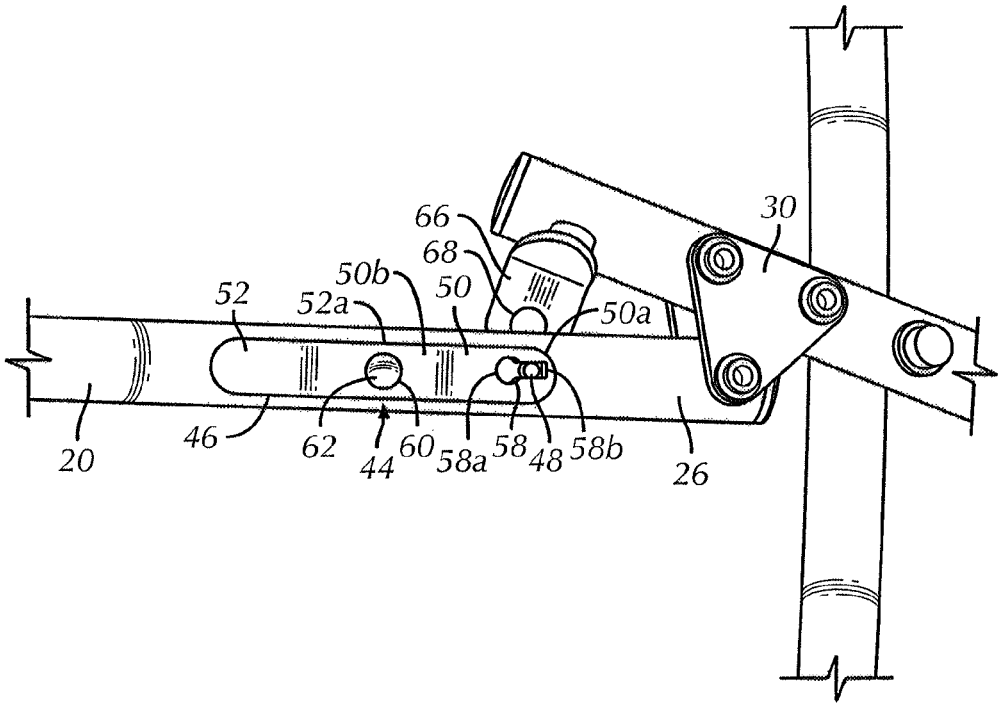
FIG. 7 is an enlarged, right side elevational view of the locking mechanism of FIG. 6.

In operation, the foldable chair 10 is reconfigurable between the folded configuration, as shown in FIGS. 4 and 5 and an unfolded configuration, as shown in FIGS. 1-3. In the folded configuration, the first and second legs 12, 14 are pivoted to a generally flat orientation that is substantially parallel to a plane defined by the seat frame 16 (FIG. 5). Thus, the foldable chair 10 provides for a compact and easily storable configuration.

In reconfiguring the foldable chair 10 from the folded configuration to the unfolded configuration, a user can grasp the first end 34 of the second leg 14 with one hand and a portion of the seat frame 16 adjacent the first end 34 with an opposing hand. Then, by separating apart the grasped portions of the foldable chair 10, the first leg 12 is caused to be pivoted about the pivot axle 37 and hinge 30 to extend the first leg 12 to its extended and locked position (FIG. 1). That is, as a result of the momentum induced on the first leg 12 resulting from the user opening up the foldable chair 10, the flange 66 of the first leg 12 cams across the beveled edge 64 of the pin 48 to move into the locked position wherein the pin 48 extends through the aperture 68 of the flange 66.

To thereafter reconfigure that foldable chair 10 to the folded configuration, the user can initially lay the first end 22 of the first leg 12 on the user's lap while seated. The user then grasps the second member 20 of the first leg 12 such that the user's fingers are positioned to apply force to the second extension 52 of the locking mechanism 44. Then, the user cantilevers the lever 46 to withdrawal the pin 48 into the second member 20 and out of engagement with the flange 66 of the first member 18. Upon disengagement of the pin 48, the user merely pulls the second member 20 towards his/her body to pivot the second end 28 of the second member 20 towards the first end 22 of the first member 18, thereby reconfiguring the folding chair 10 to the folded configuration.

Referring to FIGS. 1, 3 and 11A-C, the seat frame 16 is pivotably connected to the first and second legs 12, 14 by a pivot seat 70. The pivot seat 70 includes a planar base member 72 and pivot lobes 74*a*, 74*b* extending from each lateral side of the planar base member 72. The pivot lobes 74*a*, 74*b* each include an opening 78 extending therethrough with the openings 78 being axially aligned to receive an axle 76. The axle 76 extends through an opening 80 about the second end 28 of the second member 20 to pivotably connect the pivot seat 70 thereto (FIG. 3). The axle 76 can be secured to the pivot lobes 74*a*, 74*b*, for example, as a riveted connection. The pivot seat 70 also includes an opening 82 extending through the planar base member 72 for receiving a fastener to secure the pivot seat 70 to the seat frame 16. The pivot seat 70 can be secured to the seat frame 16 by, for example, a nut and bolt system. A pivot seat 70 also connects the second end 36 of the second leg 14 to the seat frame 16.

The foldable chair 10 further comprises a seat 84 supported by the seat frame 16. Preferably, the seat 84 is supported by an outer circumference of the seat frame 16. The seat 84 can be made as a pliable seat formed from a fabric or other suitably strong and soft material to provide comfort to a user. Exemplary materials include nylon meshes, natural and synthetic fibers, and the like. The seat 84 can also be configured with padding material, such as cotton, to provide for a comfortable seating. Additionally, the seat 84 can optionally be provided with a decorative image 86 printed on a top surface of the seat 84 to provide an aesthetic appeal. Such images can include, character images, scenic images, and any other fanciful image. The seat 84 is preferably attached to the seat frame 16 by one or more sleeves 88 (FIG. 4) woven onto the underside of the seat 84, such that the seat frame 16 is retained within the sleeve 88.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A chair reconfigurable between a folded and an unfolded configuration, the chair comprising:

a first leg having:

a first member that includes an opening, and a second member pivotably connected to the first member and including a through hole;

a second leg pivotably connected to the first leg; and a locking mechanism connected to the second member of the first leg to lock the chair in the unfolded configuration, the locking mechanism comprising:

a lever pivotably connected to the second member; and a pin connected to the lever that extends through and out of the through hole of the second member, wherein the pin is movable between a locked position, wherein the pin extends through and out of the opening of the first member and an unlocked position, wherein the pin is retracted from the opening of the first member.

2. A chair reconfigurable between a folded and an unfolded configuration, the chair comprising:

a first leg having:

a first member that includes:

a first end for supporting the chair on a support surface in the unfolded configuration, and a second end opposite the first end, and a second member that includes:

a first end pivotably connected to the second end of the first member, and a second end opposite the first end extending upwardly and rearwardly from the first end in the unfolded configuration;

a second leg having:

a first end for supporting the chair on the support surface in the unfolded configuration, a second end opposite the first end of the second leg extending upwardly and forwardly from the first end in the unfolded configuration, and an intermediate portion between the first and second ends of the second leg pivotably connected to the first member of the first leg adjacent the second end of the first member;

a catch connected to the first leg;

a locking mechanism connected to the first leg to releasably engage the catch and releasably lock the chair in the unfolded configuration; and a seat frame having a first portion pivotably connected adjacent to the second end of the second leg, and a second portion pivotably connected adjacent to the second end of the second member, wherein the second end of the second member pivots toward the first end of the first member when the chair is moved to the folded configuration.

3. A chair reconfigurable between a folded and an unfolded configuration, the chair comprising:

a first leg having:

a first member that includes:

a first end for supporting the chair on a support surface in the unfolded configuration, a second end opposite the first end, and a catch, a second member that includes:

a first end pivotably connected to the second end of the first member, a second end opposite the first end extending upwardly and rearwardly from the first end in the unfolded configuration, and a pin that releasably engages the catch;

a second leg having:

a first end for supporting the chair on the support surface in the unfolded configuration, a second end opposite the first end of the second leg extending upwardly and forwardly from the first end in the unfolded configuration, and an intermediate portion between the first and second ends of the second leg pivotably connected to the first member of the first leg adjacent the second end of the first member;

a locking mechanism connected to the first leg including the pin to releasably lock the chair in the unfolded configuration; and a seat frame having a first portion pivotably connected adjacent to the second end of the second leg, and a second portion pivotably connected adjacent to the second end of the second member, wherein the second end of the second member pivots toward the first end of the first member when the chair is moved to the folded configuration.

4. The chair according to claim 3, wherein the catch is a flange extending rearwardly about a lateral side of the first member.

5. The chair according to claim 3, wherein the pin is movable between a first position substantially within the second member and a second position extending from the second member, and wherein the second member includes a biasing member that biases the pin to the first position.

6. A chair reconfigurable between a folded, and an unfolded configuration, the chair comprising:

a first leg having:

a first member that includes:

a first end for supporting the chair on a support surface in the unfolded configuration, and a second end opposite the first end, and a second member that includes:

a first end pivotably connected to the second end of the first member, and a second end opposite the first end extending upwardly and rearwardly from the first end in the unfolded configuration;

a second leg having:

a first end for supporting the chair on the support surface in the unfolded configuration, a second end opposite the first end of the second leg extending upwardly and forwardly from the first end in the unfolded configuration, and an intermediate portion between the first and second ends of the second leg pivotably connected to the first member of the first leg adjacent the second end of the first member;

a locking mechanism connected to the second member of the first leg to releasably lock the chair in the unfolded configuration, the locking mechanism comprising:

a lever having:

a first extension that includes a first end and a second end;

a second extension extending from the second end of the first extension at an obtuse angle with respect to a plane parallel to the first extension, the second extension including an aperture for receiving an axle connected to the second member of the second leg;

a pin pivotably connected adjacent to the first end of the first extension and extending therefrom and through an opening extending through the second member, the pin including an abutment surface; and a biasing member that engages the abutment surface to bias the pin to extend through and out of the opening of the second member; and a seat frame having a first portion pivotably connected adjacent to the second end of the second leg, and a second portion pivotably connected adjacent to the second end of the second member, wherein the second end of the second member pivots toward the first end of the first member when the chair is moved to the folded configuration.

7. The chair according to claim 6, wherein the first member of the first leg includes a flange extending therefrom, the flange having an aperture for receiving the pin when the pin extends out of the opening of the second member.

8. A chair reconfigurable between a folded and an unfolded configuration, the chair comprising:

a first leg having:

a first member that includes:

a first end for supporting the chair on a support surface in the unfolded configuration, and a second end opposite the first end, and a second member that includes:

a first end pivotably connected to the second end of the first member, and a second end opposite the first end extending upwardly and rearwardly from the first end in the unfolded configuration;

a second leg having:

a first end for supporting the chair on the support surface in the unfolded configuration, a second end opposite the first end of the second leg extending upwardly and forwardly from the first end in the unfolded configuration, and an intermediate portion between the first and second ends of the second leg pivotably connected to the first member of the first leg adjacent the second end of the first member;

a locking mechanism connected to the first and second members of the first leg and configured to releasably lock the first member of the first leg to the second member of the first leg and thereby releasably lock the chair in the unfolded configuration; and a seat frame having a first portion pivotably connected adjacent to the second end of the second leg, and a second portion pivotably connected adjacent to the second end of the second member, wherein the second end of the second member pivots toward the first end of the first member when the chair is moved to the folded configuration.

9. The chair according to claim 8, wherein the first member of the first leg is pivotably connected to an upper portion of the second leg about ⅔ of the length of the second leg from the first end of the second leg.

10. The chair according to claim 8, wherein the seat frame is pivotably connected to each of the first and second legs by a pivot seat, the pivot seat comprising a planar base member having a pivot lobe extending from each side of the planar base member.

11. The chair according to claim 8, wherein the first end of the first member and the first end of the second leg is U-shaped.

12. The chair according to claim 8, further comprising a seat supported by the seat frame.

13. The chair according to claim 8, wherein the chair is reconfigurable between the folded configuration having the first and second legs pivoted to a generally flat orientation and substantially parallel to a plane defined by the seat frame, and the unfolded configuration having the first and second legs substantially perpendicular to each other.

* * * * *